US007900769B1

(12) United States Patent
Chen

(10) Patent No.: US 7,900,769 B1
(45) Date of Patent: Mar. 8, 2011

(54) CONTAINER

(76) Inventor: Kern-Jen Chen, Chiayi County (TW)

( * ) Notice: Subject to any disclaimer, the term of this patent is extended or adjusted under 35 U.S.C. 154(b) by 0 days.

(21) Appl. No.: 12/656,371

(22) Filed: Jan. 28, 2010

(51) Int. Cl.
*B65D 25/08* (2006.01)

(52) U.S. Cl. ..... 206/219; 206/524.1; 383/36

(58) Field of Classification Search ..... 206/219–221, 206/524.1, 524.4, 524.5; 141/98, 390; 383/36, 383/43, 63, 93; 47/1.01 R
See application file for complete search history.

(56) References Cited

U.S. PATENT DOCUMENTS 2,804,257 A * 8/1957 Hasler et al. ..... 383/36
5,030,013 A * 7/1991 Kramer ..... 383/61.1
5,116,139 A * 5/1992 Young et al. ..... 383/49
5,346,061 A * 9/1994 Newman et al. ..... 206/221
5,853,388 A * 12/1998 Semel ..... 206/219
6,116,780 A * 9/2000 Young et al. ..... 383/44
6,527,444 B1 * 3/2003 Buchman ..... 383/36
6,935,492 B1 * 8/2005 Loeb ..... 206/219

* cited by examiner

*Primary Examiner* — Luan K Bui
(74) *Attorney, Agent, or Firm* — Bacon & Thomas, PLLC

(57) ABSTRACT

The present invention provides a container, comprising: a cavity provided with a first opening portion; a pressure buffer area which is positioned above the cavity and the first opening portion and which is provided with a second opening portion corresponding to the first opening portion; and a thin film channel which extends through the first opening portion and the second opening portion and which has an inner channel wall and an outer channel wall, wherein the inner channel wall forms a passage for fluids with an inlet end and an outlet end, the inlet end being positioned outside the second opening portion of the pressure buffer area with a first opening and closing structure and the outlet end being positioned inside the cavity, and wherein the second opening portion is hermetically connected to the outer channel wall while the first opening portion is hermetically connected to the outer channel wall except for the area of at least one directing hole formed therebetween, such that a fluid under pressure flows back to the pressure buffer area through the directing hole.

18 Claims, 7 Drawing Sheets

CONTAINER

BACKGROUND OF THE INVENTION

1. Field of the Invention

The present invention relates to a container, and more particularly, to a crashworthy fluid container.

2. Description of the Related Art

Fluid containers that are most commonly used by consumers nowadays may include zip lock bags, aseptic packs, and polyethylene terephthalate (PET) bottles; however, these types of containers all have certain drawbacks. A zip lock bag uses a zipper to seal and lacks other specific designs to enhance its overall structure. Therefore, when a shock force exerts upon a zip lock bag containing a fluid, the zipper of the bag is more likely to burst. As for an aseptic pack, though a more crashworthy container compared to a zip lock bag, it cannot be reopened and reused like a zip lock bag. A PET bottle overcomes the above drawbacks of the other two types of containers; however, a PET bottle has a more rigid structure, making it inconvenient to store or carry and affecting its usefulness. Hence, there is a need to design a highly crashworthy container that is easy to store and easy to carry.

SUMMARY OF THE INVENTION

In view of the drawbacks of conventional containers, an object of the present invention is to provide a highly crashworthy container. A container of the present invention comprises a pressure buffer area that can reduce the impact force exerted upon the container. This design prevents the container from being broken easily and the fluid from spilling over accordingly.

In accordance with the above object, the present invention provides a container, comprising: a cavity provided with a first opening portion; a pressure buffer area which is positioned above the cavity and the first opening portion and which is provided with a second opening portion corresponding to the first opening portion; and a thin film channel which extends through the first opening portion and the second opening portion and which has an inner channel wall and an outer channel wall, wherein the inner channel wall forms a passage for fluids with an inlet end and an outlet end, the inlet end being positioned outside the second opening portion of the pressure buffer area with a first opening and closing structure and the outlet end being positioned inside the cavity, and wherein the second opening portion is hermetically connected to the outer channel wall while the first opening portion is hermetically connected to the outer channel wall except for the area of at least one directing hole formed therebetween, such that a fluid under pressure flows back to the pressure buffer area through the directing hole.

In a preferred embodiment, the cavity, the pressure buffer area, and the thin film channel are formed of the same or different material.

In a preferred embodiment, the above-mentioned material is polyethylene, polyvinyl chloride, polycarbonate, polypropylene, polyethylene terephthalate, polylactic acid, paper fiber, polyurethane, silica gel, fluorosilicone rubber, nitrile butadiene rubber, ethylene-propylene rubber, polychloroprene rubber, styrene butadiene rubber, natural rubber, a mixture or copolymer of the above, aluminum or aluminum alloy, or iron or iron alloy.

In a preferred embodiment, the first opening and closing structure uses a zipper seal structure.

In a preferred embodiment, the container is used as a substitute for lifejacket, oil barrel, or chemical container; an animal/plant breeding bag; an ice pack; or a storage bag for water, military ration, breast milk, liquid herbal medicine, or beverages.

In a preferred embodiment, the container further comprises a second opening and closing structure positioned at the other end of the cavity opposite the first opening and closing structure.

In a preferred embodiment, the above-mentioned second opening and closing structure uses a zipper seal structure.

In a preferred embodiment, a side edge of the cavity is further provided with an easy-tearing notch.

In a preferred embodiment, the cavity is used for containing fluids.

In a preferred embodiment, an inner edge side of the cavity is further provided with a plurality of pouch structures for containing substances, and preferably, each pouch structure further comprises a plurality of pouch units.

In a preferred embodiment, the above-mentioned pouch structure is made of a material that has a substantially uniform molecular orientation, and preferably, said material includes: polyethylene, polyvinyl chloride, polycarbonate, polypropylene, polyethylene terephthalate, polyurethane, silica gel, and fluorosilicone rubber.

In a preferred embodiment, the above-mentioned substance is an embryo or ovum of an organism, or a seed; food ingredient, animal feed or fertilizer in the form of granules, tablets or any other formation; a vitamin; liquid ethylene glycol/antifreeze; powdered milk; a dye; or a chemical product.

In a preferred embodiment, the above-mentioned substance is first contained in a protector and then placed into the pouch unit, and preferably, the protector is made of a mineral material that does not soften when coming into contact with the fluid in the cavity, or wherein the protector is a capsule or a thin membrane that can dissolve into the fluid contained in the cavity.

In a preferred embodiment, the bottom of the cavity is further provided with a tube part, and preferably, the tube part is further provided with a filter medium.

A container of the present invention comprises a pressure buffer area; therefore, when the container is pressed by an external force, the fluid or gas inside the container can flow to the pressure buffer area through the directing hole, thereby reducing the pressure exerted upon the container. Consequently, the container cannot be broken easily. A container of the present invention is applicable in many situations and is thus useful for containing all kinds of fluids.

DETAILED DESCRIPTION OF THE PREFERRED EMBODIMENTS

Advantages and features of the present invention will be described more fully hereinafter with reference to the accompanying drawings, in which preferred embodiments of the invention are shown. This invention may, however, be embodied in many different forms and should not be construed as limited to the embodiments set forth herein. Various changes and modifications can be made by those skilled in the art without departing from the spirit and scope of this invention. It is intended that the scope of the invention be defined by the claims appended hereto.

Figure 1:
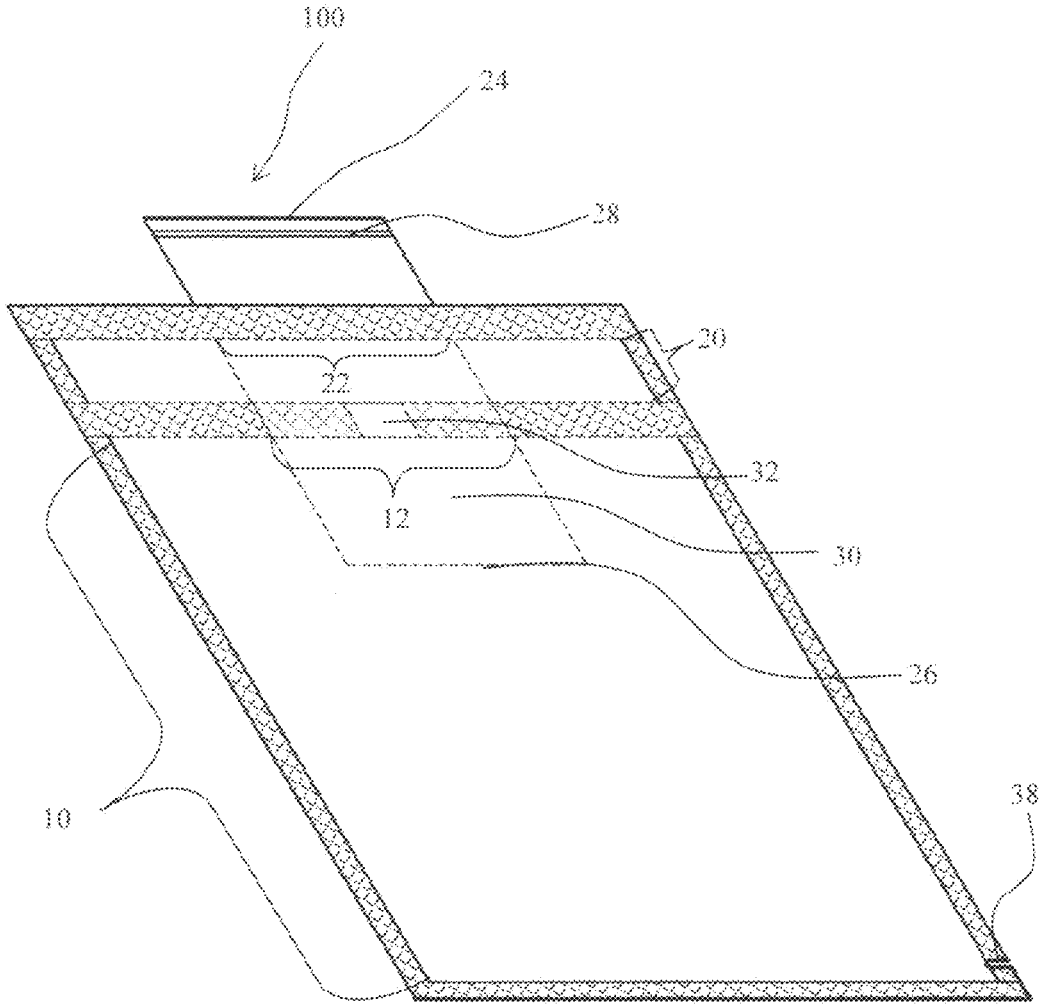
FIG. 1 is a schematic view showing a fluid container according to the present invention when no fluid is contained therein.

For the purpose of better illustration, the embodiments hereinafter only describe containers with fluids contained therein. A skilled person in the art would know that a container of the present invention may contain substances other than fluids. FIG. 1 is a schematic view showing a container according to the present invention when it is flat with no fluids contained therein. As shown in FIG. 1, a fluid container 100 of the present invention comprises: a cavity 10 provided with a first opening portion 12; a pressure buffer area 20 which is positioned above the cavity 10 and the first opening portion 12 and which is provided with a second opening portion 22 corresponding to the first opening portion 12; and a thin film channel 30 which extends through the first opening portion 12 and the second opening portion 22 and which has an inner channel wall and an outer channel wall; the inner channel wall of the thin film channel 30 forms a passage for fluids with an inlet end 24 and an outlet end 26, wherein the inlet end 24 is positioned outside the second opening portion 22 of the pressure buffer area 20 with a first opening and closing structure 28, and the outlet end 26 is positioned inside the cavity 10; the second opening portion 22 is hermetically connected to the outer channel wall (as shown by the grid area in FIG. 1) of the thin film channel 30 while the first opening portion 12 is hermetically connected to the outer channel wall except for the area of at least one directing hole 32 formed therebetween (as shown by the grid area in FIG. 1), such that a fluid under pressure flows back to the pressure buffer area 20 through the directing hole 32.

In the fluid container 100 of the present invention, the cavity 10, the pressure buffer area 20, and the thin film channel 30 may be formed of the same or different materials, which include, but are not limited to: polyethylene, polyvinyl chloride, polycarbonate, polypropylene, polyethylene terephthalate, polylactic acid, paper fiber, polyurethane, silica gel, fluorosilicone rubber, nitrile butadiene rubber, ethylene-propylene rubber, polychloroprene rubber, styrene butadiene rubber, natural rubber, a mixture or copolymer of the above, aluminum or aluminum alloy, or iron or iron alloy. In a preferred embodiment, the fluid container 100 is made of flexible materials to allow the overall compactness and portability. The materials of the fluid container 100 may be selected in accordance with the property of the fluid that is going to be contained inside. Basically, as long as the materials do not react with the fluid contained in the container, no other specific limitation is imposed on the selected materials.

Figure 2:
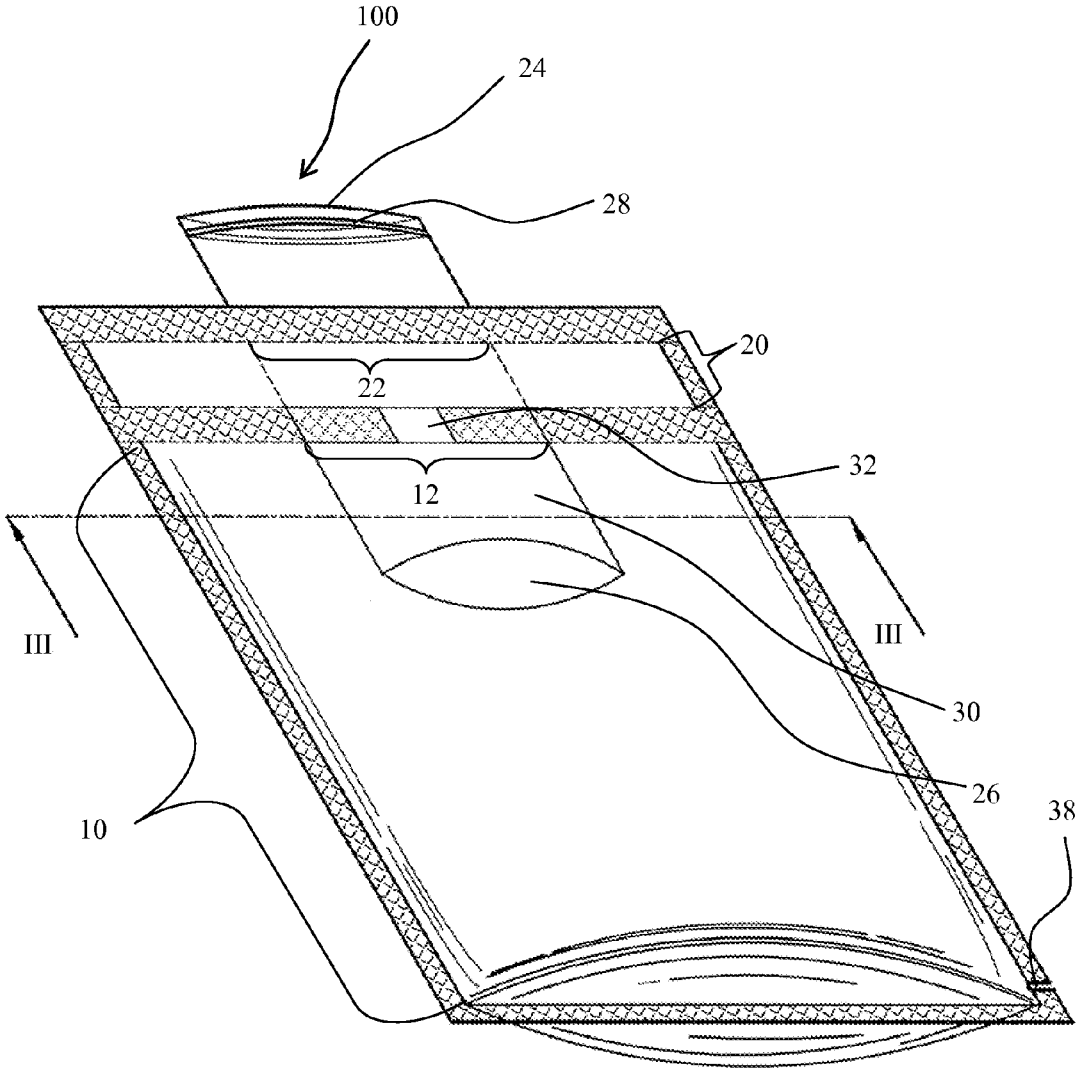
FIG. 2 is a schematic view showing the fluid container according to the present invention with a fluid contained therein.

FIG. 2 is a schematic, perspective view showing the fluid container of the present invention with a fluid contained therein. FIG. 2 will give a better understanding of how to use the container. First, through the inlet end 24 of the thin film channel 30, a fluid is introduced to be contained in the cavity 10. Here, the pressure produced by the fluid exerts upon the thin film channel 30 within the cavity 10; as a result, the thin film channel 30 is forced to close spontaneously and remain in a closed state, defining a self-closing structure that can prevent the fluid from flowing backward to exit the cavity 10. Next, the first opening and closing structure 28 is sealed by the user, so that the fluid within the container 100 is further isolated from the outside environment. The user then folds the inlet end 24 of the thin film channel 30 to cover the second opening portion 22 of the pressure buffer area 20, and folds once more to cover the first opening portion 12 of the cavity 10. A securing element is used to secure the fluid container, making the fluid more tightly sealed therein. The securing element may be, but is not limited to, an adhesive tape, clip or the like. Moreover, a person skilled in the art would know that methods for isolating the fluid in the container from the outside environment are not limited hereto, and that other known techniques in the art may also be applied to the present invention. To help the user pour out the fluid in the container more easily, a second opening and closing structure or an easy-tearing notch may be further provided at any side edge of the cavity 10. In other words, the second opening and closing structure is positioned at the end (i.e., the bottom end, not shown) of the cavity 10 opposite to the first opening portion. The first and second opening and closing structures in the present invention may use, but are not limited to, a zipper seal structure. The first opening and closing structure may even be a self-closing structure as described above, which reaches a closed state due to the pressure difference between the inside and outside of the fluid container.

Figure 3A:
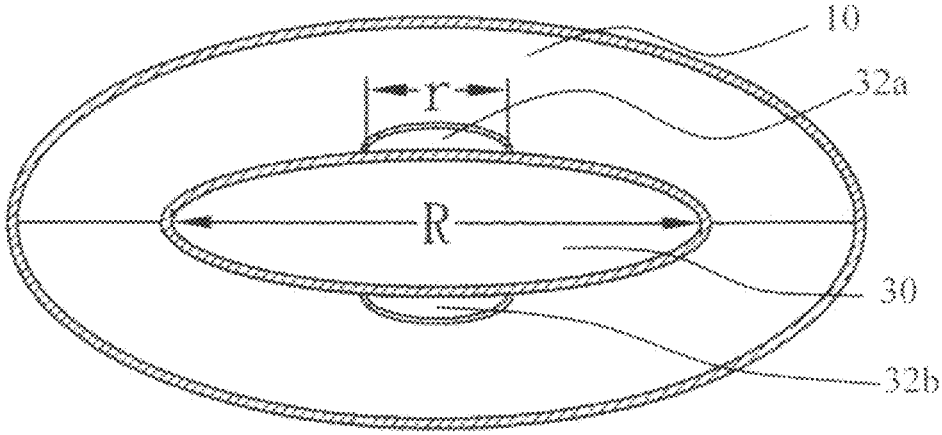
FIG. 3A is a cross-sectional view along line III-III, showing the fluid container according to the present invention when a fluid enters the cavity through the thin film channel.
Figure 3B:
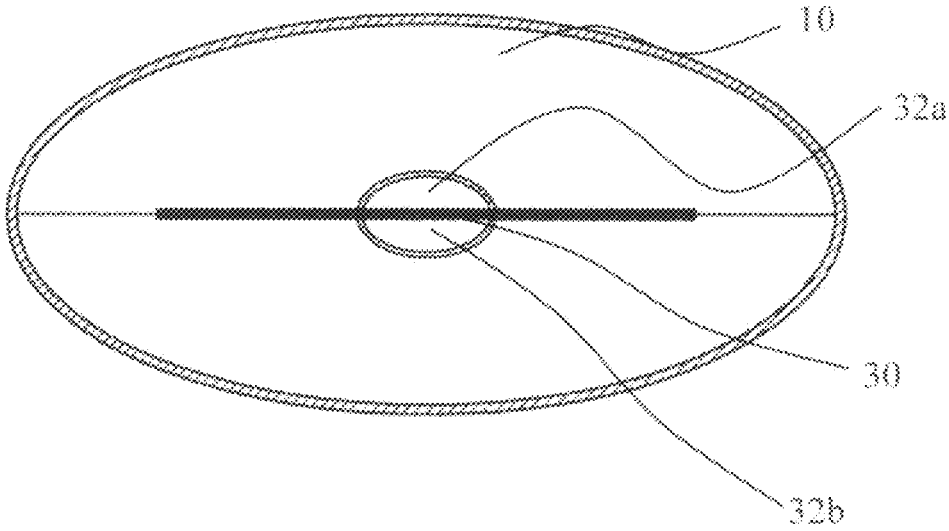
FIG. 3B is a cross-sectional view along line III-III, showing the fluid container according to the present invention when the pressure produced by the fluid exerts upon the thin film channel.

Referring to FIGS. 3A and 3B, FIG. 3A is a cross-sectional view, along line III-III, of the fluid container according to the present invention when a fluid enters the cavity 10 through the thin film channel; FIG. 3B is a cross-sectional view of the fluid container along line III-III, when the pressure produced by the fluid exerts upon the thin film channel 30. As FIG. 3A shows, a first directing hole 32*a* and a second directing hole 32*b* is provided respectively at the upper side and lower side of the thin film channel 30. The diameter of the thin film channel 30 is R, and the diameter of either the first directing hole 32*a* or the second directing hole 32*b* is r. In the present invention, the values of R and r may be the same or different as long as they are both smaller than the width of the cavity; no other specific limitation is imposed on the values of R and r. When the fluid is flowing into the cavity 10 through the thin film channel 30, the force carried by the flowing fluid stretches the thin film channel 30 open (as shown in FIG. 3A). However, when the fluid container is in use (i.e. the fluid has stopped entering the cavity 10), the pressure produced by the fluid exerts upon the thin film channel 30 within the cavity 10, thereby forcing the thin film channel 30 to close spontaneously and remain in a closed state (as shown in FIG. 3B). It should also be noted that the fluid container 100 of the present invention is made of a flexible material, and the side edges of the container are hermetically sealed using a hot pressing process. As a result, the container is flat when no fluid is contained therein, as shown in FIG. 1. And when the fluid enters the container 100, the four hermetically sealed side edges around the cavity 10 will contract toward the center of the cavity 10, thereby making the cavity 10 to inflate so that the fluid can be contained therein. Moreover, since the thin film channel 30 and the first opening portion 12 of the cavity 10 are hermetically sealed (except for the area of the directing hole 32), as the side edges of the cavity 10 contract while the cavity 10 itself inflates, the thin film channel 30 is affected and may bend or distort accordingly (the bending and distortion are not shown in FIG. 3B). In this situation, it is even harder for the fluid contained inside the cavity to flow beyond the cavity through the thin film channel. Therefore, when a shock occurs to the fluid container in use (with a fluid contained therein), since the thin film channel 30 in the cavity 10 is closed while the directing holes 32*a* and 32*b* are slightly open (as shown in FIG. 3B), the fluid will overflow into the pressure buffer area 20 (as shown in FIG. 1) through the directing holes 32*a* and 32*b*. The shock force exerted upon the fluid container is reduced; therefore, the container cannot be broken easily, and its leakage probability is reduced as well.

The fluid container may have different uses by containing different substances. For example, the container may be a breast milk storage bag, an ice pack when containing distilled water with a cooling agent, a liquid herbal medicine storage bag, or a beverage storage bag; a substitute for lifejacket, oil barrel, or chemical container; a water storage bag; an animal/plant breeding bag; or a military ration storage bag. It should be understood that the uses of the container are not limited hereto.

Figure 4:
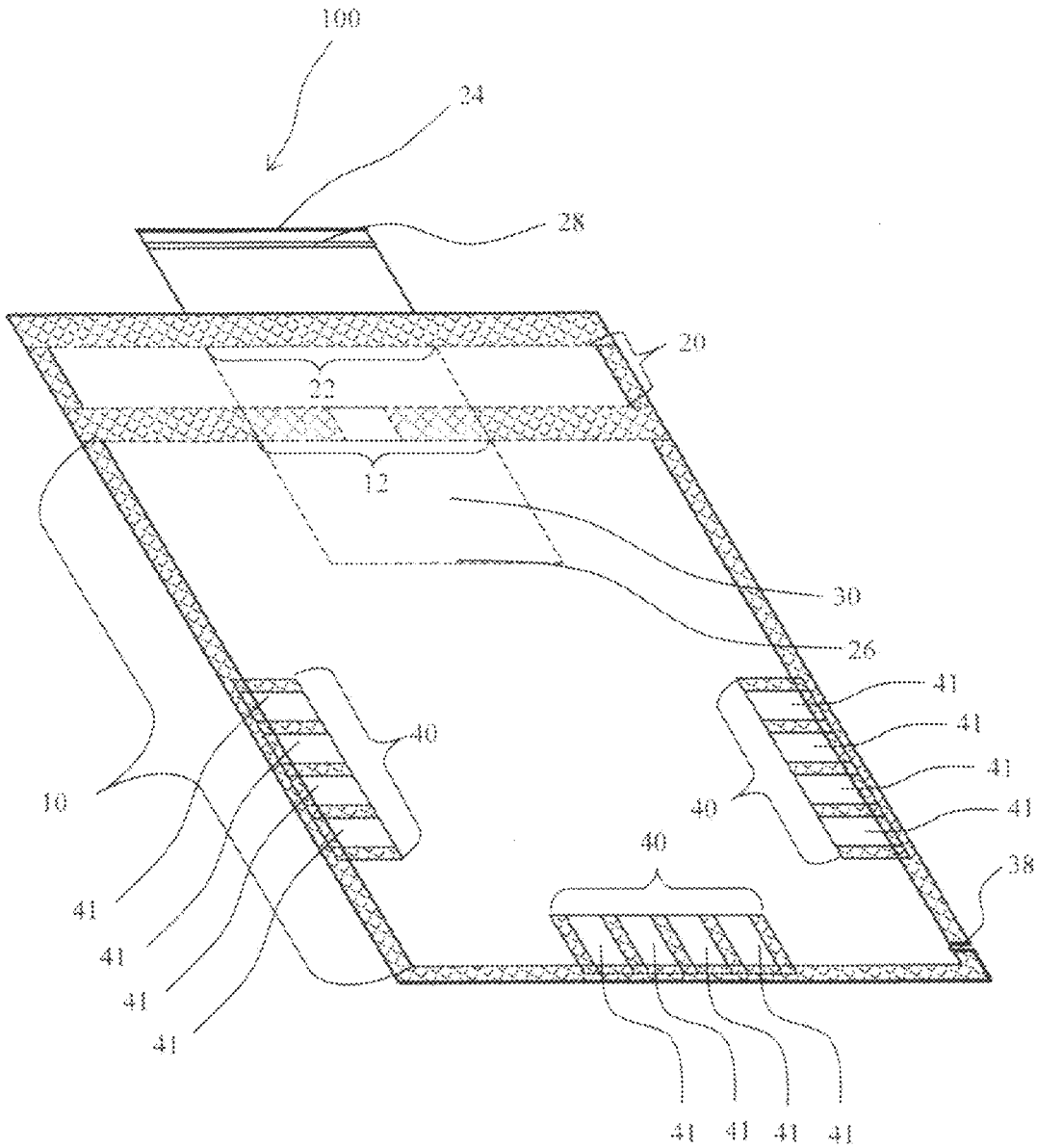
FIG. 4 is a schematic view showing a fluid container according to a second embodiment (provided with pouch structures) of the present invention when no fluid is contained therein.
Figure 5:
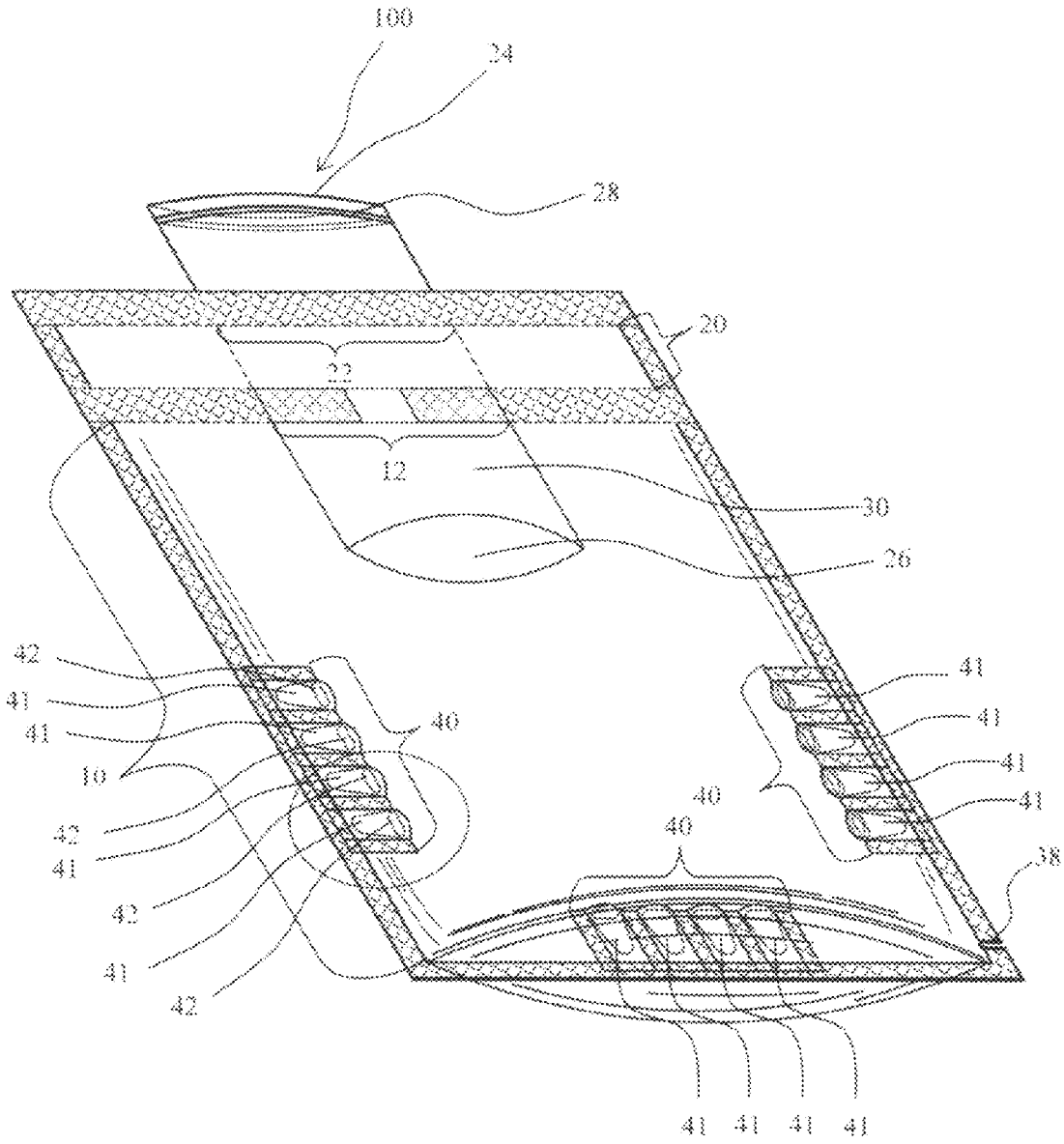
FIG. 5 is a schematic view showing the fluid container according to a second embodiment (provided with pouch structures) of the present invention, with each pouch unit having a protector therein.
Figure 6:
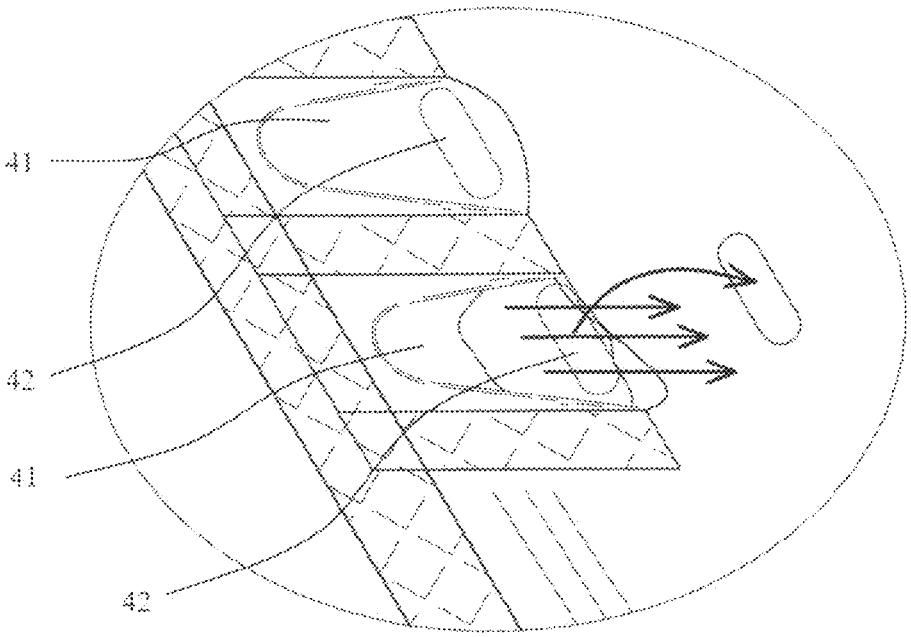
FIG. 6 is a partial, schematic view showing the pouch units of FIG. 5 when they are broken by the force applied thereto.

FIG. 4 is a schematic view showing a fluid container according to a second embodiment (provided with pouch structures) of the present invention when no fluid is contained therein. As FIG. 4 shows, in the fluid container 100, an inner edge side of the cavity 10 is further provided with a plurality of pouch structures 40 for containing substances. Each pouch structure 40 further comprises a plurality of pouch units 41 for containing the same or different substances. Preferably, the pouch structure 40 is made of a material that has a substantially uniform molecular orientation, such as polyethylene, polyvinyl chloride, polycarbonate, polypropylene, polyethylene terephthalate, polyurethane, silica gel, or fluorosilicone rubber, but the material is not limited to the above. The pouch structure 40 is made of a material that has a substantially uniform molecular orientation, and therefore, the pouch structure 40 tends to be broken more easily when a force perpendicular to the molecular orientation is applied thereto. And when the pouch structure 40 is broken, the substance contained inside will enter the cavity 10. This is a feature that the user can utilize, depending on the user's needs, to select a suitable substance to be contained in the plurality of pouch units 41 of the pouch structure 40. The substances may include but are not limited to: an embryo or ovum of an organism, or a seed; food ingredient, animal feed or fertilizer in the form of granules, tablets or any other formation; a vitamin; liquid ethylene glycol/antifreeze; powdered milk; a dye; or a chemical product. Also, the substance may be further wrapped in a protector; for example, the protector may (but is not limited to) be made of a mineral material that does not soften when coming into contact with the fluid in the cavity, or may be a capsule or a thin membrane that can dissolve into the fluid contained in the cavity. FIG. 5 is a schematic view showing the fluid container 100 according to a second embodiment (provided with pouch structures) of the present invention, with each pouch unit 41 having a protector 42 therein. The protector 42 may (but is not limited to) be used to contain liquid ethylene glycol/antifreeze, an embryo/ovum of an organism or a seed, powdered milk, or a dye. FIG. 6 is a partial, schematic view showing the pouch units 41 of FIG. 5 when they are broken by the force applied thereto. When the pouch structure 40 of the fluid container 100 is in use, the user may press the pouch units 41 in a direction toward the central part of the container (as indicated by the direction of arrows shown in FIG. 6). Since the pouch structure 40 is made of a material that has a substantially uniform molecular orientation, the pouch units will be broken easily because its molecular structure in the perpendicular direction is more vulnerable to external forces. As the pouch units 41 are broken by the pressing force, the protectors 42 can enter the cavity 10 as shown in FIG. 6. When the fluid container 100 of the present invention is used as an ice pack, for example, the protectors may be capsules that are able to dissolve into the fluid contained in the cavity, and each of the protectors 42 may contain dyes of different colors. The user may select a color that he/she is fond of and then press the pouch unit 41, so that the protector 42 containing the particular dye can enter the cavity 10. As the protector 42 starts to dissolve into the fluid contained in the cavity 10, the dye contained in the protector 42 diffuses, and the ice pack will show that particular color. That is to say, the ice pack can show different colors according to the user's choice.

Figure 7:
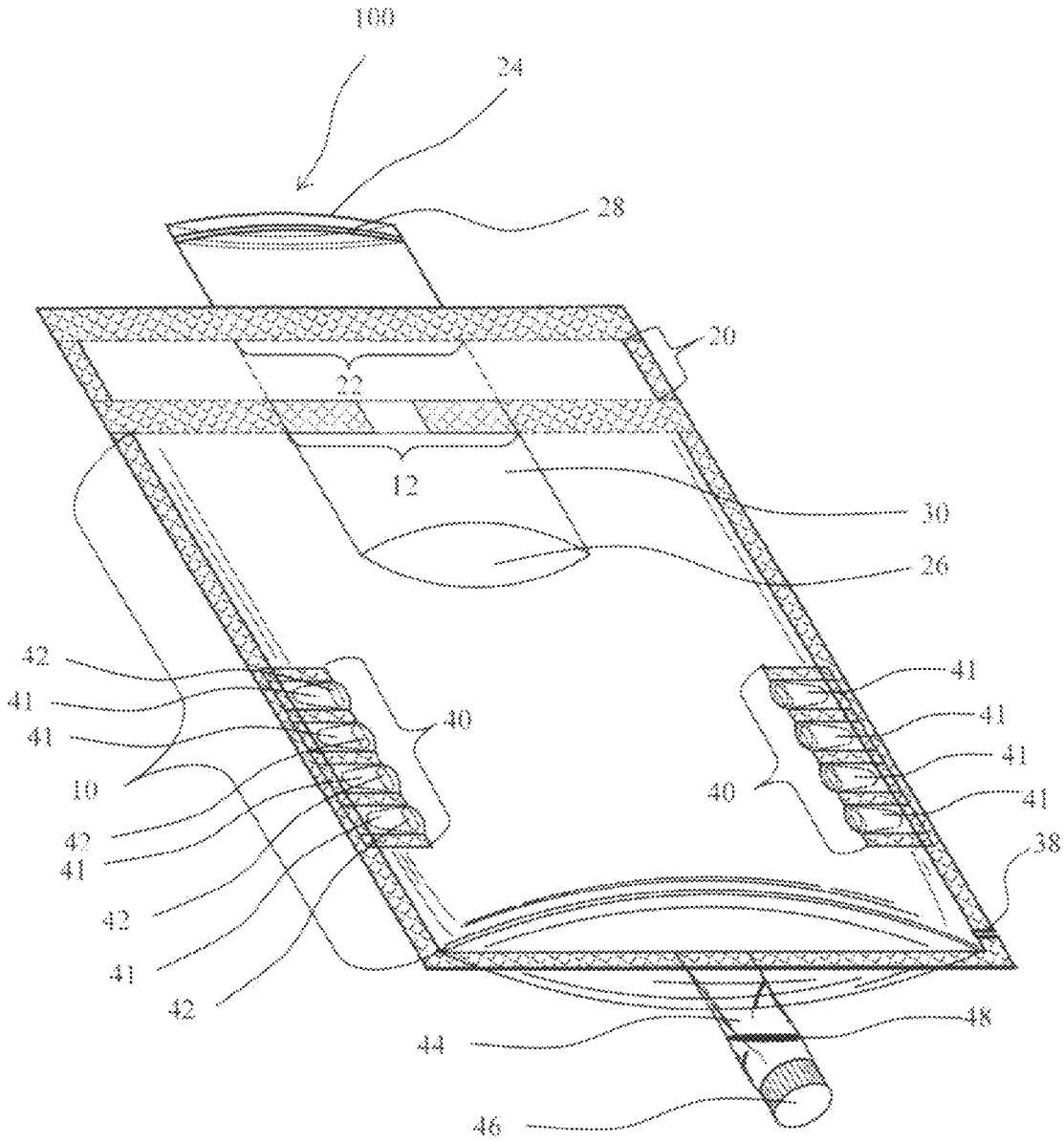
FIG. 7 is a schematic view showing a fluid container according to a third embodiment (provided with a tube part at the bottom) of the present invention.

FIG. 7 is a schematic view showing a fluid container 100 according to a third embodiment (provided with a tube part 44 at the bottom) of the present invention. As FIG. 7 shows, other than a plurality of pouch structures 40 provided at the inner side edges, the cavity 10 is further provided with a tube part 44 for feeding or discharging at the bottom. When the fluid container 100 is used as a beverage storage bag, for example, the tube part 44 may serve as a drinking straw for the user to suck a drink into the mouth; preferably, the tube part 44 is provided with a lid 46, so that the user can store the container with ease whenever he/she wants to stop taking the drink. When the fluid container 100 is used as an animal/plant breeding bag, for another example, the tube part 44 may serve as a regulator used for ecosystem controls. In that case, the tube part 44 can be used to remove dirt, foreign objects or wastes expelled from living organisms inside the cavity 10, or to control the air or water quality inside the cavity 10. The tube part 44 may be further provided with a filter medium 48, which may include but is not limited to a cotton filter, to facilitate removing the foreign objects or wastes. When the user needs to remove any foreign object, he/she may use gravity to make the foreign object sink down on the filter medium 48 of the tube part 44 and then replace the filter medium.

From the above, it is understood that the container of the present invention is more resistant to impact due to the design of a pressure buffer area. And the crashworthy feature further makes the container easy to store and carry, greatly improving its usefulness. Moreover, a container of the present invention is reusable and thus more eco-friendly.

Other Embodiments

All characteristics disclosed herein can be combined in any combination. And the characteristics disclosed herein can be replaced by any characteristics to be used for the same, equal, or similar purpose. Thus, unless otherwise specified, the characteristics disclosed herein are examples of a series of equal or similar characteristics.

In addition, based on the disclosure herein, appropriate changes and modifications may be made by those skilled in the art according to different uses and situations without departing from the spirit and scope of the invention. Therefore, other embodiments are included in the claims of the present invention.

What is claimed is:

1. A container, comprising:

a cavity provided with a first opening portion;

a pressure buffer area which is positioned above the cavity and the first opening portion and which is provided with a second opening portion corresponding to the first opening portion; and a thin film channel which extends through the first opening portion and the second opening portion and which has an inner channel wall and an outer channel wall, wherein the inner channel wall forms a passage for fluids with an inlet end and an outlet end, the inlet end being positioned outside the second opening portion of the pressure buffer area with a first opening and closing structure and the outlet end being positioned inside the cavity, and wherein the second opening portion is hermetically connected to the outer channel wall while the first opening portion is hermetically connected to the outer channel wall except for the area of at least one directing hole formed therebetween, such that a fluid under pressure flows back to the pressure buffer area through the directing hole.

2. The container according to claim 1, wherein the cavity, the pressure buffer area, and the thin film channel are formed of the same or different material.

3. The container according to claim 2, wherein the material is polyethylene, polyvinyl chloride, polycarbonate, polypropylene, polyethylene terephthalate, polylactic acid, paper fiber, polyurethane, silica gel, fluorosilicone rubber, nitrile butadiene rubber, ethylene-propylene rubber, polychloroprene rubber, styrene butadiene rubber, natural rubber, a mixture or copolymer of the above, aluminum or aluminum alloy, or iron or iron alloy.

4. The container according to claim 1, wherein the first opening and closing structure uses a zipper seal structure.

5. The container according to claim 1, wherein the container is used as a substitute for lifejacket, oil barrel, or chemical container; an animal/plant breeding bag; an ice pack; or a storage bag for water, military ration, breast milk, liquid herbal medicine, or beverages.

6. The container according to claim 1, further comprising a second opening and closing structure positioned at the other end of the cavity opposite the first opening and closing structure.

7. The container according to claim 6, wherein the second opening and closing structure uses a zipper seal structure.

8. The container according to claim 1, wherein a side edge of the cavity is further provided with an easy-tearing notch.

9. The container according to claim 1, wherein the cavity is used for containing fluids.

10. The container according to claim 9, wherein an inner edge side of the cavity is further provided with a plurality of pouch structures for containing substances.

11. The container according to claim 10, wherein each pouch structure further comprises a plurality of pouch units.

12. The container according to claim 10, wherein the pouch structure is made of a material that has a substantially uniform molecular orientation.

13. The container according to claim 12, wherein the material includes: polyethylene, polyvinyl chloride, polycarbonate, polypropylene, polyethylene terephthalate, polyurethane, silica gel, and fluorosilicone rubber.

14. The container according to claim 10, wherein the substance is an embryo or ovum of an organism, or a seed; food ingredient, animal feed or fertilizer in the form of granules, tablets or any other formation; a vitamin; liquid ethylene glycol/antifreeze; powdered milk; a dye; or a chemical product.

15. The container according to claim 10, wherein the substance is first contained in a protector and then placed into the pouch unit.

16. The container according to claim 15, wherein the protector is made of a mineral material that does not soften when coming into contact with the fluid in the cavity, or wherein the protector is a capsule or a thin membrane that can dissolve into the fluid contained in the cavity.

17. The container according to claim 10, wherein the bottom of the cavity is further provided with a tube part.

18. The container according to claim 17, wherein the tube part is further provided with a filter medium.

* * * * *